US008677916B2

(12) United States Patent
James et al.

(10) Patent No.: US 8,677,916 B2
(45) Date of Patent: Mar. 25, 2014

(54) MULTI-NEEDLE QUILTING MACHINE AND NEEDLE AND LOOPER DRIVE MECHANISM THEREFOR AND METHOD OF OPERATING SAME

(75) Inventors: Michael A. James, Davie, FL (US); Jeff A. Kaetterhenry, Algonquin, IL (US)

(73) Assignee: L&P Property Management Company, South Gate, CA (US)

( * ) Notice: Subject to any disclaimer, the term of this patent is extended or adjusted under 35 U.S.C. 154(b) by 209 days.

(21) Appl. No.: 13/108,602

(22) Filed: May 16, 2011

(65) Prior Publication Data

US 2012/0097083 A1 Apr. 26, 2012

Related U.S. Application Data

(60) Provisional application No. 61/406,306, filed on Oct. 25, 2010.

(51) Int. Cl.
*D05B 11/00* (2006.01)
*D05B 69/02* (2006.01)

(52) U.S. Cl.
USPC ..... 112/117; 112/220

(58) Field of Classification Search
USPC ..... 112/163–168, 117–119, 220, 221, 237
See application file for complete search history.

(56) References Cited

U.S. PATENT DOCUMENTS 476,456 A * 6/1892 Fefel ..... 112/165
1,221,857 A 4/1917 Hildt
1,659,443 A * 2/1928 Redin ..... 112/162
2,989,018 A * 6/1961 Bleicher ..... 112/475.04
3,398,709 A * 8/1968 De Koninck ..... 112/162
3,425,377 A 2/1969 Scharmer, Jr.
3,450,081 A * 6/1969 Rabinow ..... 112/221
3,669,045 A * 6/1972 Landoni ..... 112/118
3,886,880 A 6/1975 Watson, Sr.
4,006,697 A 2/1977 Robertson
4,470,360 A 9/1984 Gerlach
4,690,081 A 9/1987 Castagna et al.
5,154,130 A 10/1992 Gribetz et al.
5,287,819 A * 2/1994 Beatty et al. ..... 112/80.01
5,299,516 A * 4/1994 Sakuma ..... 112/162
5,465,674 A * 11/1995 Gosche ..... 112/162
5,505,150 A 4/1996 James et al.

(Continued)

OTHER PUBLICATIONS

European Patent Office, "International Search Report and Written Opinion," in corresponding International Application No. PCT/US2011/057652, mailed Mar. 8, 2012, 9 pp.

*Primary Examiner* — Ismael Izaguirre
(74) *Attorney, Agent, or Firm* — Wood, Herron & Evans, LLP

(57) ABSTRACT

A multi-needle quilting machine is provided with a common drive that drives the needles and loopers. It may also drive the presser foot assembly. In the illustrated embodiment, a drive motor drives a rotating drive shaft. The drive shaft has an off-center drive assembly connected to it that rocks a needle rocker shaft as well as looper rocker shafts, and also a presser foot shaft. The off-center drive includes a pair of eccentrics on the drive shaft at each side of the machine. Each eccentric oscillates a linkage plate that is fixed to a shaft such as the needle rocker shaft and is also linked to the looper rocker shafts and the presser foot shaft. The eccentric thereby reciprocates the needles and oscillates the loopers, as well as reciprocates the presser foot plate, in permanent synchronization.

8 Claims, 6 Drawing Sheets

(56) References Cited

U.S. PATENT DOCUMENTS

| | | | | |
|---|---|---|---|---|
| 5,509,365 | A | 4/1996 | Cash | |
| 6,145,456 | A | 11/2000 | Codos | |
| 6,170,414 | B1 | 1/2001 | Kaetterhenry et al. | |
| 7,073,453 | B2 | 7/2006 | Frazer et al. | |
| 7,735,439 | B1 | 6/2010 | Price et al. | |
| 7,845,295 | B2 * | 12/2010 | Park | 112/220 |
| 2007/0261620 | A1 | 11/2007 | James et al. | |

* cited by examiner

MULTI-NEEDLE QUILTING MACHINE AND NEEDLE AND LOOPER DRIVE MECHANISM THEREFOR AND METHOD OF OPERATING SAME

This application claims the benefit of Application Ser. No. 61/406,306, filed on Oct. 25, 2010, the entirety of which is hereby expressly incorporated herein by reference.

FIELD OF THE INVENTION

The present invention relates to multiple needle chain stitch quilting, and particularly to methods and apparatus for driving the needle, looper, and pressure foot assemblies in such machines.

BACKGROUND OF THE INVENTION

Multi-needle quilting machines are used in the commercial manufacture of large size quilted products such as mattress covers and comforters. One such machine is described in U.S. Pat. No. 5,154,130, hereby expressly incorporated herein by reference. These machines include multiple needle arrays that reciprocate each of a plurality of needles simultaneously through a multiple layered quilted fabric, typically in a motion that is sinusoidal as function of time, to sew a separate series of chain stitches with each needle. The needles cooperate with a plurality of loopers or hooks in a corresponding array on the opposite side of the fabric from the needles to form double lock chain stitches in each of the series. The loopers are similarly driven simultaneously in an oscillating angular motion about an axis that is also usually a sinusoidal function of time. In addition to the motions of the needles and loopers, there is the motion of a presser foot plate or plates situated on the same side of the fabric as the needles that reciprocate to compress the multiple layered fabric in synchronization with the needle motion to facilitate the sewing.

Usually, the motion of the needles, the motion of the loopers, and the motion of the presser foot plate or plates are driven by a common drive motor through a common rotary drive shaft that extends transversely across the machine. Typically, the needles and loopers have been driven by separate eccentrics located on the drive shaft, with the presser foot plates driven by linkage from the eccentric that drives the needles. The separate eccentric drives have been provided because the needle assemblies and looper assemblies have been treated as different motions that should be separately adjusted during manufacture and maintenance. The separate drives also distribute the different loads of the various assemblies.

More recently, a third eccentric drive has been deemed desirable for machines of the prior art for separately driving the pressure foot assembly. One such drive is disclosed in U.S. Pat. No. 7,735,439.

While the separate eccentric drive systems have been regarded as serving engineering purposes in the prior art, they are associated with certain levels of vibration, maintenance, and manufacturing costs, the reduction of which would be desirable to machine manufacturers and owners. Such separate systems also have the ability to lose synchronization, making maintenance important to avoid machine malfunction and damage.

SUMMARY OF THE INVENTION

It is a primary objective of the present invention to eliminate the problems of the quilting machine drive systems of the prior art. It is a more particular objective of the invention to reduce vibration, cost and maintenance of multi-needle quilting machine drive systems, to simplify machine assembly, to insure proper synchronization of loopers and needles in such machines, and to increase part life and machine speed.

According to principles of the present invention, a multi-needle quilting machine is provided with a common, off-center drive connection from a main common rotating drive shaft. The off-center drive system of the illustrated embodiment is an eccentric drive system in which a common drive shaft is provided with one or more eccentrics, each eccentric driving both the needle assembly and the looper assembly of the machine in a reciprocating or oscillating motion. More particularly, in the illustrated embodiment of the invention, each eccentric shares the load and drives the needle assembly, the looper assembly, and the presser foot assembly in synchronized motions.

DETAILED DESCRIPTION OF THE DRAWINGS

Figure 1A:
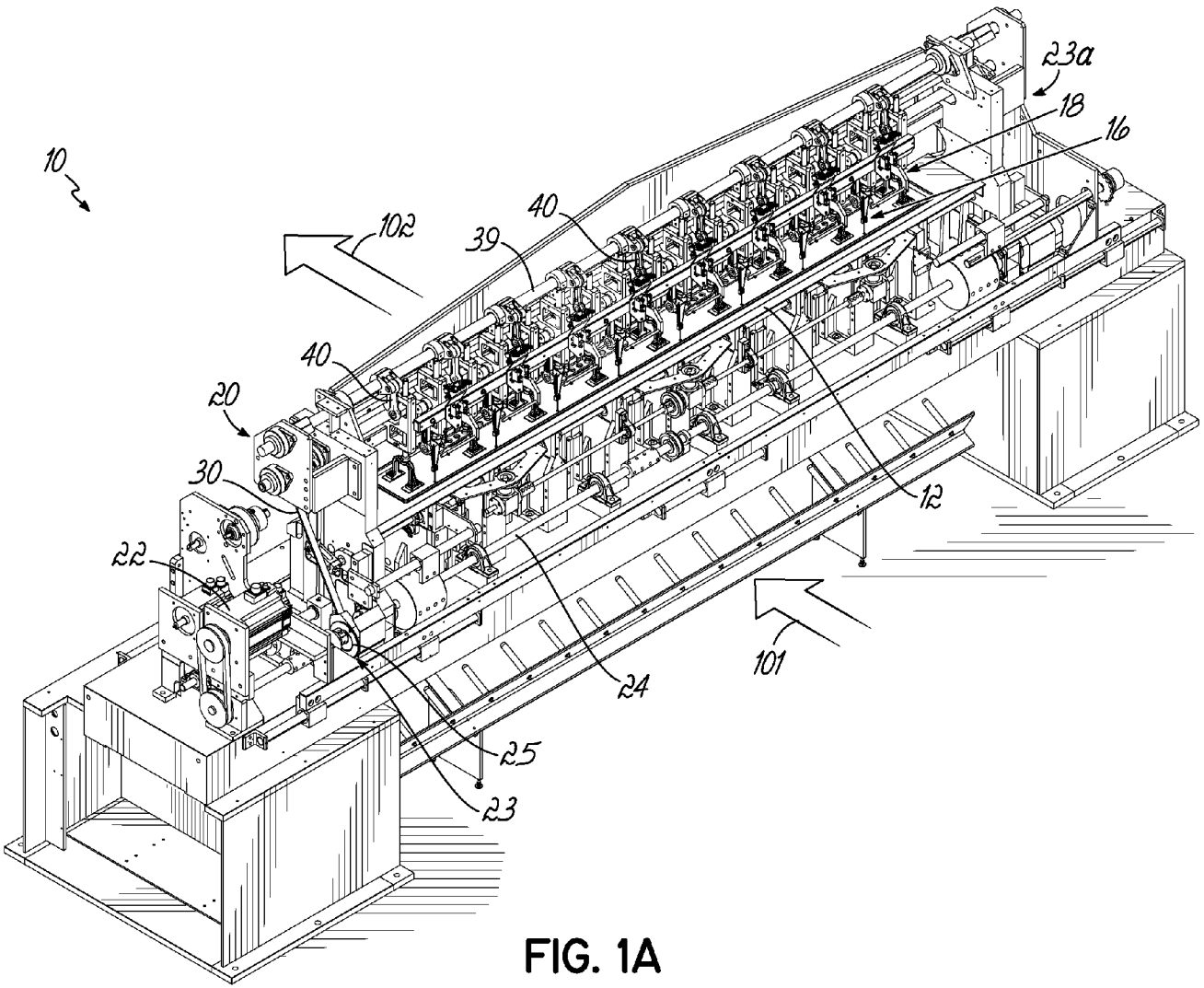
FIGS. 1A and 1B are respective front and back perspective views of one embodiment of a multi-needle quilting machine having a drive system according to principles of the present invention.
Figure 1B:
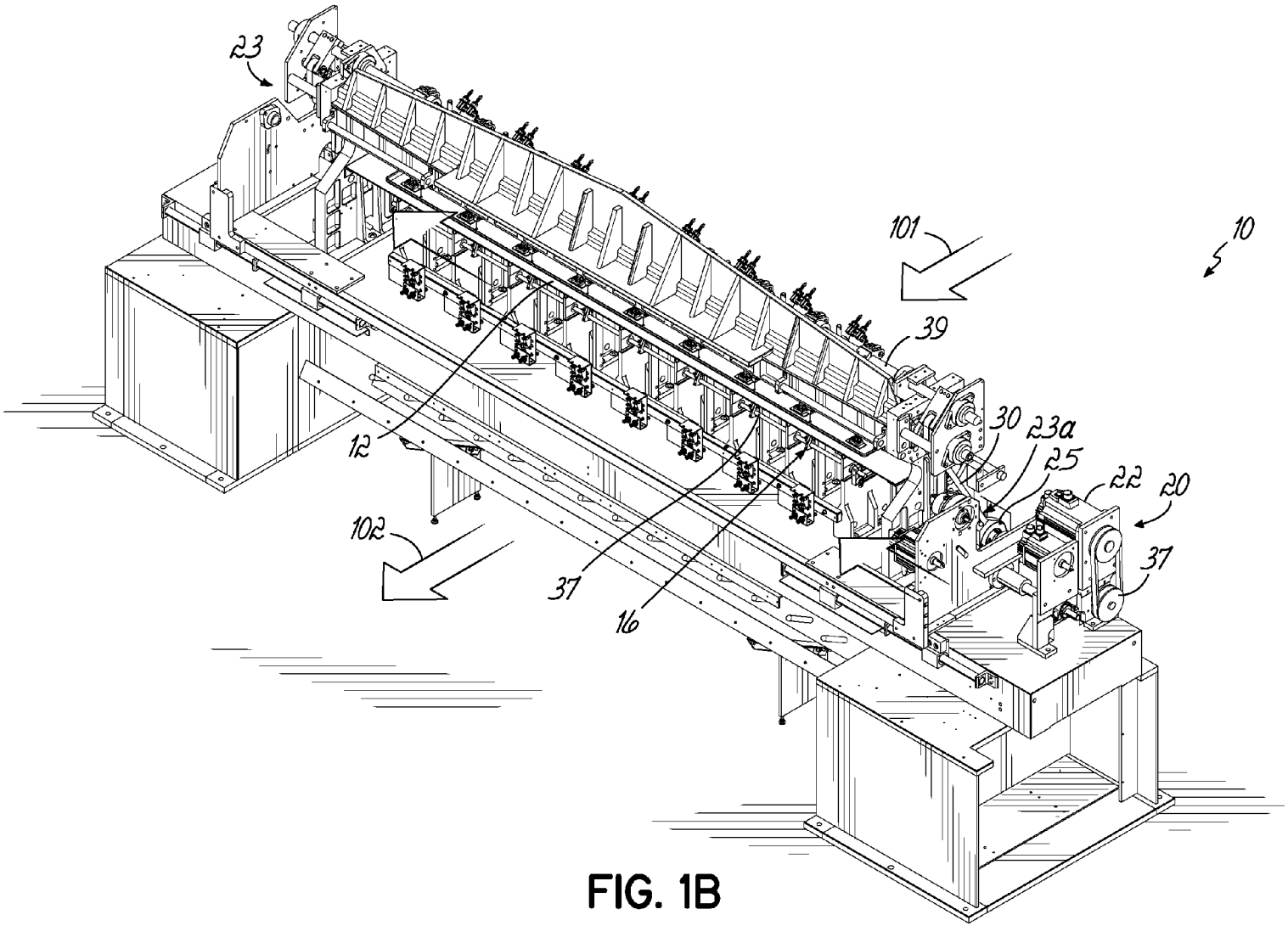

FIGS. 1A and 1B illustrate a multi-needle quilting machine 10 of a type used for quilting wide webs of material into quilted products such as mattress covers. Stacked material webs enter the machine 10 at the front, indicated by arrow 101, proceed through the machine 10 where they are sewn together by the application of series of chain stitches sewn in patterns, and exit the machine 10 at the rear, indicated by arrow 102, to be cut from the quilted web into mattress cover panels. The machine 10 has a needle plate 12 for supporting a fabric for quilting. The needle plate 12 is typically a single plate that has an array of holes for allowing needles to pass through the material from a front or facing side to engage loopers. The machine 10 also has a needle assembly 14 that includes an array of needles 15, usually arranged in a plurality of rows, typically two or three, disposed above the needle plate 12, and linkages for reciprocating the array of needles 15 simultaneously through the fabric, typically a web of multi-layered material, supported on a needle plate 12. The machine also includes a looper assembly 16 having an array of loopers 17 that corresponds to the array of needles and is disposed below the needle plate 12. The array of loopers 17 includes one looper 17 for each of the operating needles, forming an array of needle-looper pairs, with each looper 17 driven to oscillate in cooperation with each of the needles to form double lock chain stitch sequences in the fabric. The machine 10 also includes a presser foot assembly 18 on the needle side of the needle plate 12 for clamping the fabric to the needle plate 12 during stitch formation.

Figure 2A:
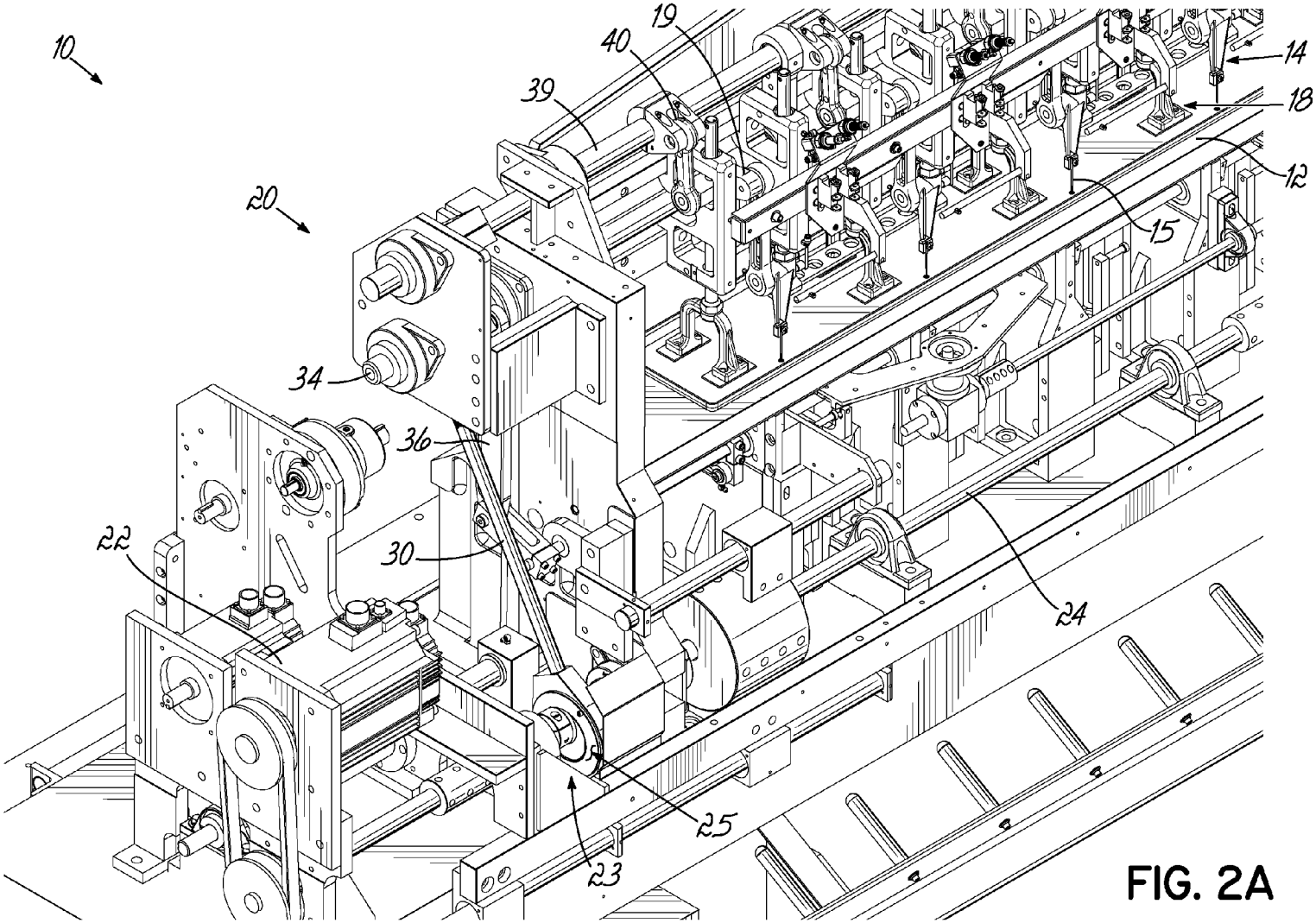
FIGS. 2A and 2B are cut-away perspective views of a portion of the multi-needle quilting machine of FIG. 1A showing a drive according to one embodiment of the present invention.
Figure 2B:
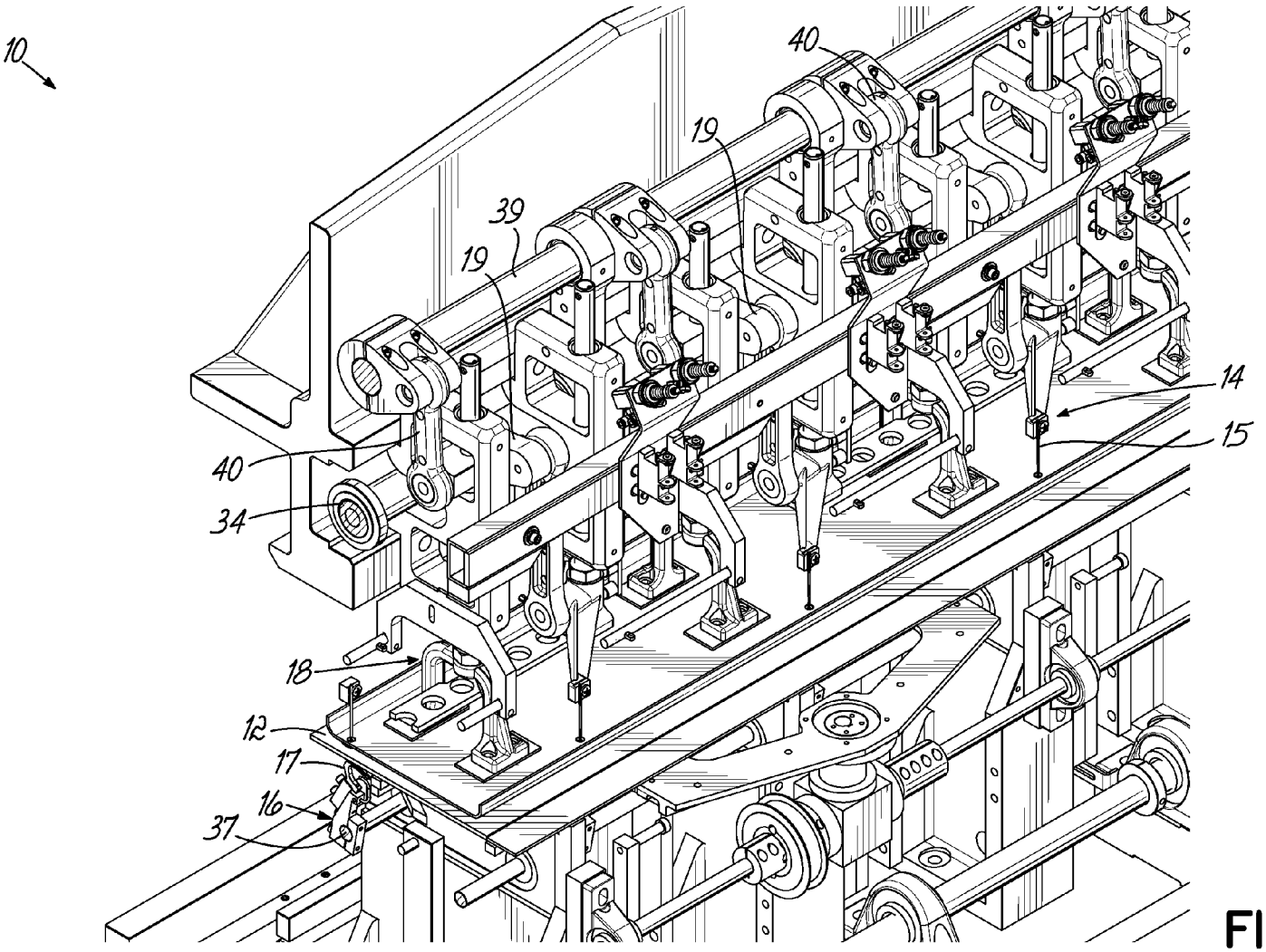

FIGS. 2A and 2B illustrate a drive system 20 that includes a drive motor 22 having an output drive shaft 24 that extends transversely across the machine 10. During machine operation, the drive shaft 24 rotates continuously, with each rotation of the shaft 24 driving the needles and loopers to form one stitch with each needle-looper pair in each of the chain-stitch sequences in the fabric. Drive linkage 30 is provided that connects the needle 15 and looper 17 arrays to the drive shaft 24 to impart reciprocating motion to the needles 15 and oscillating motion to the loopers 17 in response to the rotation of the drive shaft 24, at one cycle per rotation of the shaft 24. The presser foot assembly 18 is similarly driven in synchronization with the reciprocation of the needles.

Figure 3:
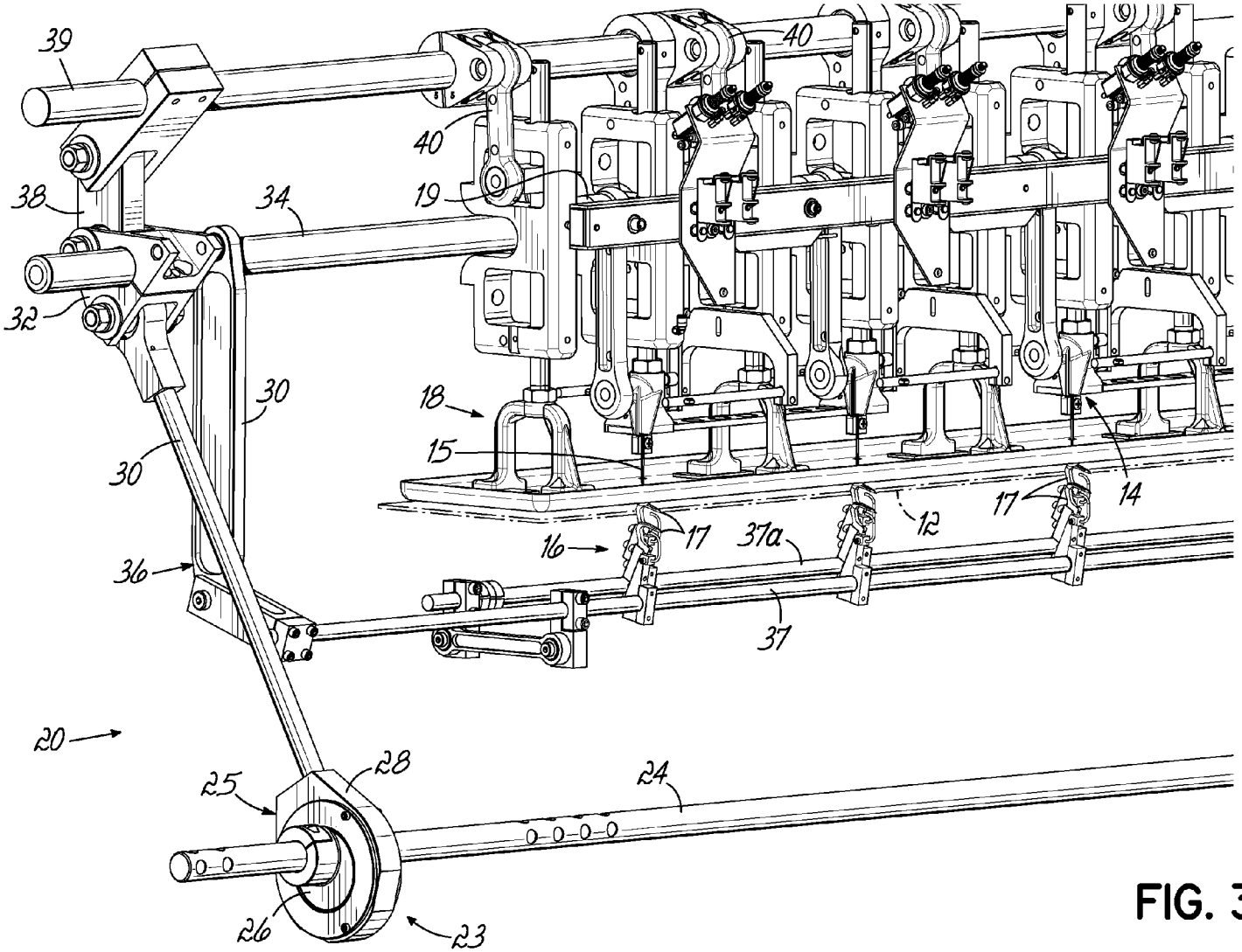
FIG. 3 is a perspective view depicting a common eccentric drive of the off-center drive portion of the drive system of FIGS. 2A and 2B for driving the needle assembly, the looper assembly, and the presser foot assembly of the machine of FIGS. 1A and 1B.
Figure 4:
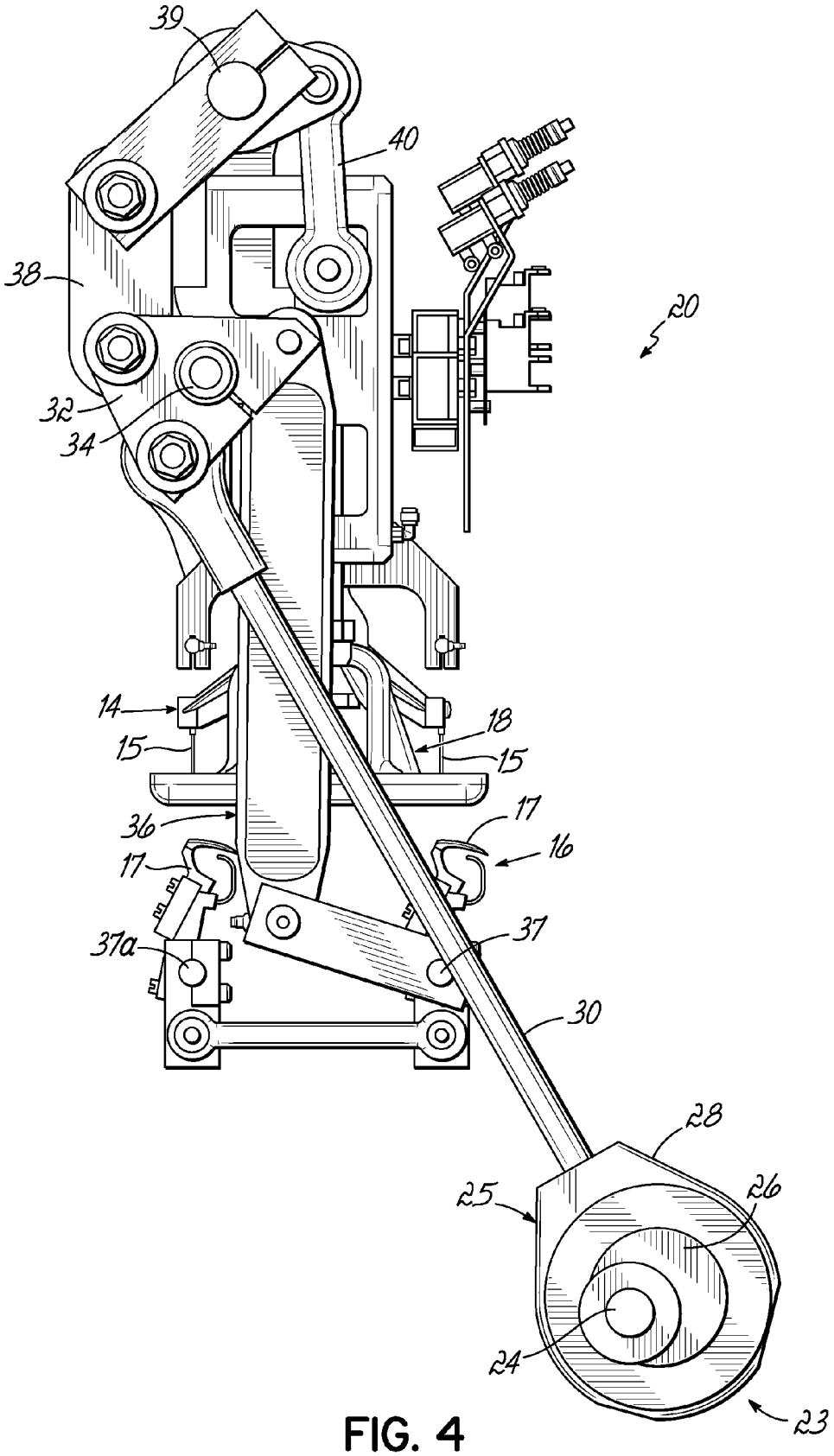
FIG. 4 is an end view of the eccentric drive of FIG. 3.

As best shown in FIGS. 3 and 4 in accordance with principles of the present invention, the reciprocating and oscillating motions of the needles 15 and loopers 17 are driven by a common off-center drive element or elements 23 connected to the drive shaft 24. Such off-center drive elements 23 may be in the form of eccentric drive elements, cranks, cams, or some other linkage for producing a reciprocating or oscillating motion from the rotary motion of the shaft 24. In the illustrated embodiment, the off-center drive 23 is an eccentric drive element on the shaft 24 or, more particularly, a pair of such elements 23 and 23*a*, one at each end of the drive shaft 24 at each side of the machine to more evenly distribute the driving load forces. More particularly, on the drive shaft 24 at each side of the machine 10 is an eccentric drive element 25 that includes a circular cam 26 eccentrically mounted to the drive shaft 24 to rotate with the drive shaft 24 and a cam follower 28 rotatably mounted to the outer circular surface of the cam 26. A drive link 30 is fixed at one end thereof to the cam follower 28 to reciprocate with the cam follower 28 as the cam 26 rotates with the rotation of the drive shaft 24.

The drive link 30 drives both the needle assembly 14 and the looper assembly 16 and, more particularly, all three of the assemblies, including the needle assembly 14, the looper assembly 16, and the pressure foot assembly 18. While a single drive element 25 can be used, two identical elements 25 are provided at each side of the machine 10 on the shaft 24 to share the drive loads and balance the forces on the drive components. More than two can alternatively be used. In the machine 10, the needle array includes two rows of needles 15 that are ganged together on a common reciprocating assembly 14, while the looper array includes two rows of loopers 17 on two respective looper rocker shafts that correspond to the two rows of needles 15.

Referring to FIGS. 2A, 2B, 3 and 4, the end of the drive link 30 opposite from the end attached to the follower 26 is pivotally linked to a linkage plate 32 that is fixed to a needle drive rocker shaft 34 to rock the needle drive rocker shaft in an oscillating motion. The needle drive rocker shaft 34 is linked to the needle assembly 14 through linkage 19 that drives the needle assembly 14 in an up and down reciprocating motion that pokes the needles 15 of the needle array through, and raises the needle array out of, the material being quilted. Also pivotally linked to the linkage plate 32 is a looper drive linkage assembly 36 that drives looper rocker shaft 37 and 37*a* of the looper assembly 16 to oscillate the looper drive rocker shafts 37 and 37 in synchronization with the reciprocating of the needles 14. Similarly, pivotally linked to the linkage plate 32 is the presser foot drive linkage 38 that drives the presser foot rocker shaft 39 of the presser foot assembly 18. The presser foot drive linkage 38 is positioned to drive the presser foot plate assembly 18 slightly over center to create two bottom positions to a slight dwell in the presser foot assembly motion.

The looper drive rocker shaft 37 extends to the opposite sides of the machine 10 to attach to a looper drive linkage 36 of each of two eccentric drive elements at each side of the machine 10 and at the sides of the web being quilted. The extended looper drive rocker shaft 37 is provided with torsion tube sections 137 to stiffen and minimize torsional distortion of the looper drive rocker shaft 37. The looper drive rocker shaft 37 has one row of loopers 17 mounted on it. A second row of loopers 17 is mounted on the shaft 37, which extends parallel to the shaft 37 and is linked to it through rocker linkage 41 so that all of the loopers 17 oscillate together in synchronization.

With the needles and loopers driven by a common eccentric or other common off-center drive from the drive shaft 24, the needles 15 and loopers 17 remain synchronized and cannot come out of synchronization. Each single eccentric drive element 25 drives both the needle drive rocker shaft 34 and the looper drive rocker shafts 37 and 37. In addition, in the illustrated embodiment, the presser foot drive shaft 39 is also driven by the same common eccentric drive element or elements, so that the needles, loopers, and presser foot or feet always remain synchronized.

In the illustrated embodiment, the presser foot assembly is designed to depress the presser foot or feet past a maximum downward position so that the linkage connection rises slightly and descends again toward the maximum downward position, thus creating a dwell in the presser foot assembly motion at the maximum downward position. A coupling 40 is provided to link the presser foot assembly to the presser rocker shaft 39 in a way that produces this dwell in the presser foot motion when the pressure foot is in the down position. Such a linkage could, in some embodiments, provide a dwell or double down motion. The present invention is particularly advantageous where this dwell or modified sinusoidal presser foot motion is present.

While the motions of the needle, looper, and presser foot assemblies remain synchronized, adjustment linkages can be provided to link any or all of these assemblies to the common eccentric drive element 25, thereby facilitating the setting of the timing of the respective motions of these assemblies and their positions relative to each other.

Although only certain exemplary embodiments of this invention have been described in detail above, those skilled in the art will readily appreciate that various modifications can be made without departing from the principles of the present invention. Accordingly, all such modifications are intended to be included within the scope of this invention.

What is claimed is:

1. A multi-needle, chain-stitch, quilting machine comprising:

a needle plate assembly to support a web of multi-layered material for quilting;

a plurality of needles arranged in an array supported on one side of the needle plate assembly;

a corresponding plurality of loopers arranged in a corresponding array supported on the opposite side of the needle plate assembly from that on which the needles are supported;

each of the needles corresponding to one of the loopers to form one of a plurality of chain-stitch forming elements, simultaneously operable to each sew a separate one of a plurality of series of chain stitches across the web of multi-layered material;

a pressure foot assembly situated on the same side of the needle plate assembly as the needles;

a drive motor having a rotatable output drive shaft extending transversely across the machine from one side thereof to the other;

a needle drive assembly operable to reciprocate the needles simultaneously through a multi-layered material supported by the needle plate assembly;

a looper drive assembly operable to oscillate the loopers simultaneously in a chain stitch forming relationship with the needles on the side of the needle plate assembly on which the loopers are supported;

a presser foot drive assembly operable to reciprocate the presser foot assembly against and away from the material supported by the needle plate; and an off-center drive assembly comprising two common off-center drive elements, connected to the output drive shaft, one at each side of the machine, the common off-center drive elements each having a reciprocating motion in response to rotation of the output drive shaft;

the needle drive assembly being coupled, on each side of the machine, to one of the common off-center drive elements so as to reciprocate the needles simultaneously through a multi-layered material in response to the reciprocating motion of the off-center drive assembly; and the looper drive assembly being coupled, on each side of the machine, to one of the common off-center drive elements so as to oscillate the loopers simultaneously in a chain stitch producing relationship with the needles in response to said reciprocating motion.

2. The quilting machine of claim 1 wherein:

the presser foot drive assembly is coupled, on each side of the machine, to one of the common off-center drive so as to reciprocate the presser foot assembly against and away from the material supported by the needle plate in response to said reciprocating motion.

3. The multi-needle quilting machine of claim 1 wherein:

the off-center drive elements each include a circular cam eccentrically mounted to the output drive shaft, and a cam follower ring rotatably mounted to the cam, and a drive link having a first end thereof pivotally attached to the cam follower and a second end; and the needles and the loopers being respectively driven by a needle drive assembly and a looper drive assembly, the assemblies being each drivably connected to the second end of the drive link.

4. The multi-needle quilting machine of claim 1 wherein:

one of said needle drive and looper drive assemblies has a linkage plate at each side thereof;

the off-center drive assembly having two drive links, each having a first end thereof pivotally linked to the drive shaft and a second end connected to a linkage plate; and the other of said needle drive and looper drive assemblies being drivably connected to each of the linkage plates.

5. The quilting machine of claim 4 wherein:

the presser foot drive assembly is coupled each to the linkage plate so as to reciprocate the presser foot assembly against and away from the material supported by the needle plate in response to said reciprocating motion.

6. A multi-needle quilting machine comprising:

a needle plate assembly to support a web of multi-layered material for quilting;

a plurality of needles arranged in an array supported on one side of the needle plate assembly;

a corresponding plurality of loopers arranged in a corresponding array supported on the opposite side of the needle plate assembly from that on which the needles are supported;

a pressure foot assembly situated on the same side of the needle plate assembly as the needles;

a drive motor having a rotatable output drive shaft;

a needle drive assembly operable to reciprocate the needles simultaneously through a multi-layered material supported by the needle plate assembly;

a looper drive assembly operable to oscillate the loopers simultaneously in a chain stitch forming relationship with the needles on the side of the needle plate assembly on which the loopers are supported;

a presser foot drive assembly operable to reciprocate the presser foot assembly against and away from the material supported by the needle plate;

an off-center drive assembly connected to the output drive shaft and operable to produce a reciprocating motion in response to rotation of the output drive shaft;

the needle drive assembly being coupled to the off-center drive assembly so as to reciprocate the needles simultaneously through a multi-layered material in response to the reciprocating motion produced by the off-center drive assembly;

the looper drive assembly being coupled to the off-center drive assembly so as to oscillate the loopers simultaneously in a chain stitch producing relationship with the needles in response to said reciprocating motion;

the off-center drive comprising:

an eccentric drive assembly including a circular cam eccentrically mounted to the output drive shaft and a cam follower ring rotatably mounted to the cam;

a drive link having a first end thereof pivotally attached to the cam follower and a second end, and the needle drive assembly and the looper drive assembly being each drivably connected to the second end of the drive link;

the off-center drive assembly including two eccentric drive assemblies, one at each end of the drive shaft at opposite sides of the machine, and each including:

an eccentric drive assembly including a circular cam eccentrically mounted to the output drive shaft, a cam follower ring rotatably mounted to the cam, and a drive link having a first end thereof pivotally attached to the cam follower and a second end;

the looper drive assembly includes a looper rocker shaft having ends extending toward the opposite sides of the machine beyond the sides of a web of material supported on the machine for quilting; and the second end of the drive links of the eccentric drives being connected to the looper rocker shaft at the extending ends thereof.

7. The quilting machine of claim 6 wherein:

the presser foot drive assembly is coupled to the off-center drive assembly so as to reciprocate the presser foot assembly against and away from the material supported by the needle plate in response to said reciprocating motion.

8. The quilting machine of claim 7 wherein:

the presser foot drive assembly is coupled to the off-center drive assembly so as to reciprocate the presser foot assembly against and away from the material supported by the needle plate in response to said reciprocating motion.

* * * * *